US006321656B1

(12) United States Patent
Johnson

(10) Patent No.: US 6,321,656 B1
(45) Date of Patent: Nov. 27, 2001

(54) THERMALLY ACTUATED RELEASE MECHANISM

(75) Inventor: Randolph T. Johnson, Waldorf, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/533,084

(22) Filed: Mar. 22, 2000

(51) Int. Cl.[7] ..... F42B 15/36; F42B 15/34
(52) U.S. Cl. ..... 102/377; 102/481
(58) Field of Search ..... 102/377, 481

(56) References Cited

U.S. PATENT DOCUMENTS

| | | | | |
|---|---|---|---|---|
| H1144 | * | 3/1993 | Cherry et al. | 60/39.1 |
| 4,753,465 | | 6/1988 | Dalby et al. . | |
| 4,841,730 | | 6/1989 | McDonald . | |
| 5,035,182 | | 7/1991 | Purcell et al. . | |
| 5,036,658 | * | 8/1991 | Tate | 60/253 |
| 5,176,275 | | 1/1993 | Bowie . | |
| 5,311,820 | * | 5/1994 | Ellingsen | 102/481 |
| 5,312,152 | | 5/1994 | Woebkenberg et al. . | |
| 5,394,803 | * | 3/1995 | Mort | 102/377 |
| 5,482,574 | | 1/1996 | Goldstein . | |
| 5,735,114 | * | 4/1998 | Ellingsen | 60/39.1 |
| 5,787,947 | | 8/1998 | Hertsgaard . | |

FOREIGN PATENT DOCUMENTS

| | | | | |
|---|---|---|---|---|
| 2 038 918 | * | 7/1980 | (GB) | E05C/21/00 |

* cited by examiner

*Primary Examiner*—Charles T. Jordan
*Assistant Examiner*—Kimberly S Smith
(74) *Attorney, Agent, or Firm*—Mark Homer

(57) ABSTRACT

A container subject to damage through inadvertent overheating and pressure build up such as a rocket casing containing a propellant which can be subjected to damage or inadvertent firing when the ignition temperature is achieved inadvertently includes a thermally actuated release mechanism. The rocket casing includes two sections which are mechanically latched. A thermally responsive material such as Nitinol is provided in a shape such that upon being subjected to a predetermined transition temperature lower than the ignition temperature of the rocket propellant, it changes shape so as to mechanically unlatch the rocket casing sections.

7 Claims, 2 Drawing Sheets

THERMALLY ACTUATED RELEASE MECHANISM

This application is assigned to the United States Government as represented by the Secretary of the Navy.

BACKGROUND OF THE INVENTION

This invention relates to devices for protecting against pressure build up resulting from undesirable overheating and, more particularly, to a thermally actuated release mechanism for venting of a container such as a rocket casing where the pressure build up can result in catastrophic damage to personnel and property in the vicinity.

As a result of a number of well publicized accidents in recent years involving premature and inadvertent activation of munitions with resultant loss of life among service personnel as well as other damage, there has been an increased emphasis on "insensitive munitions" which are safer to store, handle and use. A specific problem relates to the build up of combustion gases in rocket motors and similar devices when the ignition temperature of the contents of the rocket is reached inadvertently. The inadvertent elevation of temperature can occur, for example, when storing, handling, or deploying rockets in the vicinity of a fire or jet exhaust or the like. A failure or inability to vent these gases can result in catastrophic damage personnel and property.

A number of attempts have been made to achieve venting of rocket casings including the use of explosive charges to rupture the casing, the use of various mechanisms to be actuated or deactuated prior to use of the rocket and complex pressure vessels designed to disintegrate upon heating. None of these attempts has produced a universal solution. Typically these attempted solutions have been bulky and complex in design resulting in increased costs, decreased reliability and, in some cases, adding an additional hazard.

Accordingly, it is an object of this invention to provide a safer rocket by providing a simple, inexpensive yet effective release mechanism for achieving venting of a rocket container under elevated temperatures and internal pressure.

It is a further object of this invention to provide such a release mechanism which is compact and conserves space within the rocket casing.

It is a further object of this invention to provide such a release mechanism which can be used in a variety of other applications requiring relief from pressure build up.

DETAILED DESCRIPTION OF THE PREFERRED EMBODIMENTS

Figure 1:
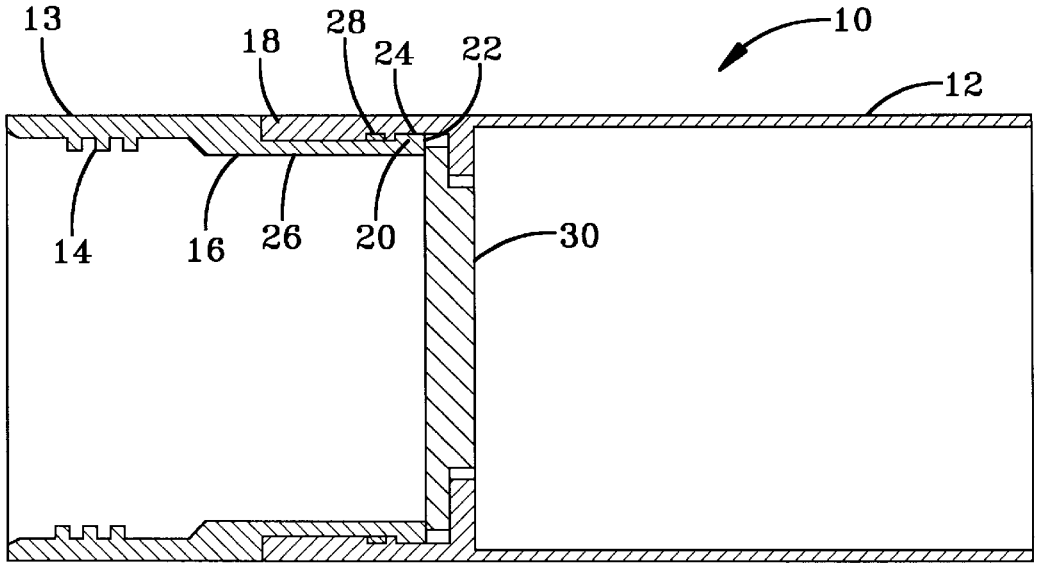
FIG. 1 is sectional view of a first preferred embodiment of a release mechanism according to this invention.

Referring now to the drawings, particularly FIG. 1, there is shown a first embodiment of this invention. A portion of a rocket casing system, shown generally at 10, has a main aft section 12 and a forward section 13 attached thereto. Section 13 includes a threaded portion 14 for receiving a warhead (not shown) in threaded engagement. Section 12 contains the rocket motor propellant (not shown). At the joint between sections 12 and 13, section 12 has an inner component 16 which engages an outer component 18 of section 13. It will be understood that sections 12 and 13 are cylindrical in shape. Inner component 16 includes a series of prongs 20 arranged circumferentially with tang portions 22 which normally engage with a groove or slot portion 24 on the inner diameter of outer component 18. A second groove or slot portion 26 on the inner diameter of outer component 18 contains a ring 28 made of a thermally responsive "shape memory" material such as Nitinol, an alloy of nickel and titanium. The Nitinol ring 28 is annealed to a configuration in which its inner diameter is equal to its final diameter after heating; which diameter is smaller than the normal functioning diameter of the joint between sections 12 and 13. After annealing, the ring 28 is swaged or pressed into groove 26. When the ring 28 is heated past its crystalline transition temperature, it reverts to its annealed configuration, thus constricting inner component 16 and disengaging it from the outer component 18 thereby unlatching sections 12 and 13. A wall portion 30 divides the interior of sections 12 and 13 and abuts inner component 16. Since the temperature rise at ring 28 is accompanied by a build up of pressure in the interior of section 13, wall 30 cooperates to disengage the sections. Although the latching mechanism which maintains sections 12 and 13 in locked together engagement has been shown as series of prong members, portions of which engage a groove in the outer component, it will be understood that other latching mechanisms such as a lock wire, threads or the like can be employed so long as the latching mechanism does not prevent compression of the inner component 16 to a diameter at which it disengages from outer component 18. Further this diameter must be within the "shape memory" of the Nitinol ring. The ring 28 allows the inner component 16 to remain engaged with outer component 18 in normal use and operation and the joint between casing sections 12 and 13 is normally engaged until it is deactivated by an outside intervention or by the ring 28 through heating. Ignition temperatures for double base rocket propellant are approximately 250° F. More modern composite propellants ignite in approximately the 300° F. to 400° F. range. Therefore, the crystalline transition temperature of the ring 28 should be below those ignition temperatures for use in rocket applications.

Figure 2:
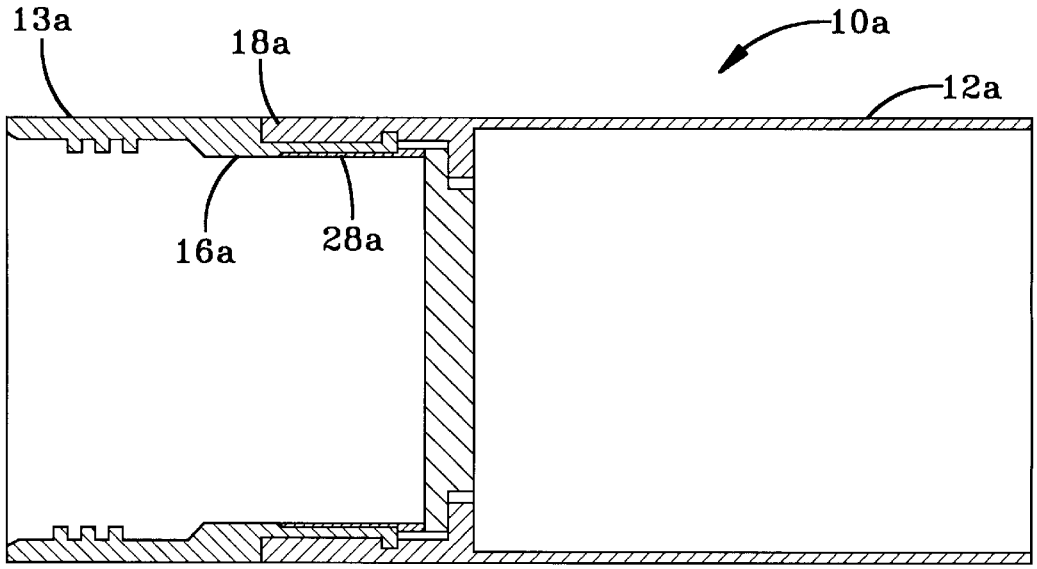
FIG. 2 is sectional view of a second embodiment of the invention.

Referring to FIG. 2, a casing portion, shown generally at 10*a*, includes sections 12*a* and 13*a*. A Nitinol ring or sleeve 28*a* is annealed to a configuration in which its outer diameter is equal to its final diameter after exposure to heat; which diameter is less than the normal functioning diameter of the joint between sections 12*a* and 13*a*. The ring 28*a* is assembled into the inner component 16*a* after the insertion of the inner component 16*a* into outer component 18*a*. Ring 28*a* is then swaged or otherwise forced radially outward, thereby increasing its diameter and forcing the inner component 16*a* into engagement with outer component 18*a*. When the sleeve 28*a* is heated beyond its transition temperature, ring or sleeve 28*a* retracts to its annealed configuration thereby releasing inner component 16*a* from its engagement with outer component 18*a* to return to its normal disengaged condition.

Figure 3:
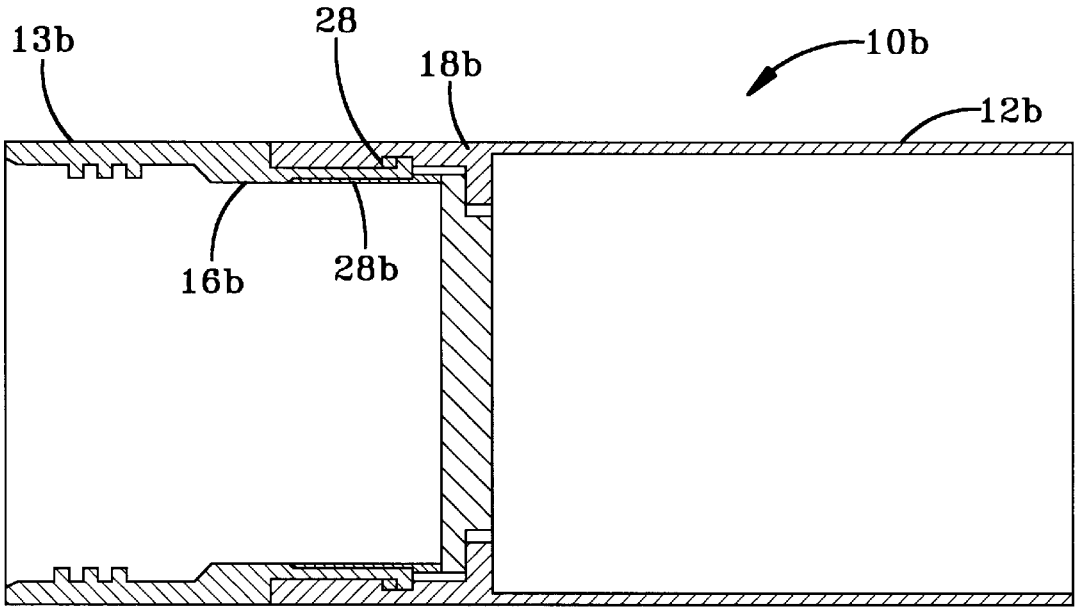
FIG. 3 is sectional view of a third embodiment of the invention.

Referring to FIG. 3, there is shown generally at 10*b* a third embodiment of this invention incorporating the features of both FIGS. 1 and 2. In this embodiment, when the rings or sleeves 28*b* and 28*c* are heated beyond their transition temperatures, inner sleeve 28*b* releases and outer ring 28 pushes inner component 16*b* radially inward to effect disengagement of sections 12*b* and 13*b*. This arrangement achieves positive locking in both the engaged and disengaged positions without relying on the properties of the inner component 16*b* to engage or disengage from outer component 18*b*.

It can be seen that the objects of the invention have been achieved and a thermally actuated release mechanism has been provided which is compact, simple in construction, inexpensive effective and which can be useful at providing venting in other applications.

What is claimed is:

1. A thermally actuated release device, comprising:

a container system having first and second sections, the container being subject to deleterious temperature and pressure build up from within the container, means for latching the first and second sections together having locked and unlocked positions, and;

a shape memory alloy mounted in operative engagement with and separately from the latching means, having a first shape when subjected to a first temperature and a second shape when subjected to a second temperature, wherein the first shape forces the latching means to remain in the locked position and the second shape forces the latching means into the unlocked position.

2. A releasing device as set forth in claim 1, wherein the "shape memory" alloy comprises Nitinol.

3. A releasing device as set forth in claim 1, wherein the latching means further comprises a series of prongs on the first section which engage with a groove on the second section.

4. A releasing mechanism as set forth in claim 1, wherein the latching means provides complete engagement between the first and second sections in the locked position and provides complete disengagement of the first and second sections in the unlocked position.

5. A releasing device as set forth in claim 1, wherein the container system comprises a rocket casing system.

6. A releasing device as set forth in claim 5, further comprising:

propellant within the rocket casing system wherein burning the propellant causes increasing pressure within the rocket casing system and an operating temperature less than the second temperature.

7. A releasing device as set forth in claim 6, wherein the second temperature comprises from about 250° F. to about 400° F.

* * * * *